US005733176A

United States Patent [19]

Robinson et al.

[11] Patent Number: 5,733,176

[45] Date of Patent: Mar. 31, 1998

[54] POLISHING PAD AND METHOD OF USE

[75] Inventors: Karl M. Robinson; Michael A. Walker, both of Boise, Id.

[73] Assignee: Micron Technology, Inc., Boise, Id.

[21] Appl. No.: 653,239

[22] Filed: May 24, 1996

[51] Int. Cl.[6] ..... B24B 1/00

[52] U.S. Cl. ..... 451/41; 451/285; 451/286; 451/287; 451/288; 451/289; 451/527; 451/539; 451/921; 437/228; 156/636.1

[58] Field of Search ..... 451/41, 921, 539, 451/527, 21, 8, 56, 526, 285–290; 156/636.1, 645.1, 626.1; 437/228, 718

[56] References Cited

U.S. PATENT DOCUMENTS

| | | | |
|---|---|---|---|
| 4,019,289 | 4/1977 | Korver | 451/921 |
| 5,144,773 | 9/1992 | Flores et al. | 451/8 |
| 5,439,551 | 8/1995 | Meikle et al. | 156/626.1 |
| 5,483,568 | 1/1996 | Yano et al. | 451/8 |

FOREIGN PATENT DOCUMENTS

| | | | |
|---|---|---|---|
| 363312072 | 12/1988 | Japan | 451/21 |
| 403281168 | 12/1991 | Japan | 451/21 |

*Primary Examiner*—Robert A. Rose
*Assistant Examiner*—George Nguyen
*Attorney, Agent, or Firm*—Workman, Nydegger & Seeley

[57] ABSTRACT

A novel polishing pad having voids and optional abrasives incorporated therein is disclosed. The contents of each void facilitates the detection of the end point at which the polishing pad becomes worn out during a polishing operation. Chemicals stored within voids are released by the breaching of the voids caused by the polishing operation. The chemical released is selected to halt the chemical polishing, change the color of the pad, or to detectably change the torque load on the rotating fixed abrasive pad. Empty voids cause an noise from fluids such as air being forced into the voids. The visual or audible diagnostic resulting from the breaching of voids help to control the polishing operation and thus increase yield.

62 Claims, 2 Drawing Sheets

POLISHING PAD AND METHOD OF USE

BACKGROUND OF THE INVENTION

1. The Field of the Invention

The present invention relates generally to polishing of surfaces such as glasses, semiconductors, and integrated circuits. More particularly, this invention relates to polishing pads that contain end-point detection means and a method of using the stone that will indicate the article's "worn out" status, either by automation or such that an operator of a chemical mechanical polishing machine for semiconductor wafers will see, hear, or otherwise detect the end point.

2. The Relevant Technology

Polishing solutions, polishing pads, or slurries generally consist of abrasive particles. With slurries, a part or substrate to be polished is bathed or rinsed in the slurry in conjunction with an elastomeric pad which is pressed against the substrate and rotated such that the slurry particles are pressed against the substrate under load. With fixed-abrasive pads, an abrasive is contained within the pad itself, and the substrate can be polished in either a wet or a dry application. The technique can be accomplished by chemical, mechanical, or chemical-mechanical planarization (CMP). The lateral motion of the fixed-abrasive pad causes the abrasive particles to move across the substrate surface, resulting in pad wear and volumetric removal of the substrate surface. CMP can involve alternative holding and rotating a semiconductor wafer against a wet or dry polishing platen under controlled chemical, pressure and temperature conditions. Typically, CMP uses an aqueous colloidal silica solution as the abrasive fluid. Alternatively, the pad itself will contain all the abrasive embedded within its wear surface. The polishing mechanism is a combination of mechanical action and the chemical reaction of the material being polished with the solution.

In the semiconductor industry, CMP is used for a variety of surface planarizations. There are various types of planarizable surfaces on a wafer, including conductive and insulating materials, such as oxides, tetraethyl orthosilicate, also referred to as tetraethoxysilane (TEOS), nitrides, polysilicon, single crystalline silicon, amorphous silicon, and mixtures thereof. The substrate of the wafer containing the conductive or non-conductive material is generally a semiconductors material, such as silicon.

As circuit densities increase, CMP has become one of the most viable techniques for planarization particularly for interlevel dielectric layers. In view of this increasing viability, improved methods of CMP are increasingly being sought.

One aspect of CMP in need of improvement is end-point detection of the polishing pad's useful life. This end point occurs before the pad has worn completely through and must be discovered before the wafer being polished is irreparably damaged by the underlying polishing platen. Although optimizing speed and throughput of the process for semiconductor manufacture are economic imperatives, avoiding damage to any given wafer that happens to be in the polisher at the time the pad's useful life has expired is also a desired result.

In general, CMP is a relatively slow and time-consuming process. During the polishing process, semiconductor wafers must be individually loaded into a carrier, polished and then unloaded from the carrier. The polishing step in particular is time consuming and may require several minutes. In past practice, the operator would be required to keep an accounting of the number of wafer polishings for a given pad, and then based upon past experience, discard the pad before it had completely worn out and damaged the current wafer being polished. The "past experience" method was the previous state of the art.

Because semiconductor polishing is in a constant state of flux, different techniques have been developed in the art for increasing the speed and throughput of the CMP process. As an example, more aggressive aqueous solutions have been developed to increase the speed of the polishing step. Higher carrier downforces and higher RPMs for the polishing platen are also used.

Although current polishing techniques are somewhat successful, they may adversely affect the polishing process and the uniformity of the polished surface. Worn-pad end-point detection, for instance, is more difficult to estimate when aggressive solutions and higher carrier downforces are employed. In addition, the polishing process may not proceed uniformly across the surface of the wafer. The hardness or composition of a dielectric layer or the polishing platen may vary in certain areas. This in turn may cause a dielectric layer to polish faster or slower in some areas effecting its global planarity. This problem may be compounded by aggressive solutions, higher carrier downforces, and increased RPMs.

The constant change in semiconductor processing technology and the ever-increasing complexity wafers and polishing techniques, makes the "past experience" method a more difficult task for the operator to estimate when a pad is sufficiently worn.

In view of these and other problems of prior art CMP processes, there is a need in the art for improved methods of worn-pad CMP detection.

SUMMARY AND OBJECTS OF THE INVENTION

This invention overcomes the problems encountered in the prior art by providing an abrasive polishing pad that is self limiting and that also provides detectible and/or automated means for announcing the worn abrasive polishing pad's end point during a chemical mechanical polishing operation.

Accordingly, it is an object of the present invention to provide an improved method of worn-pad CMP detection. It is a further object of the present invention to provide improved methods of CMP that are suitable for large scale semiconductor manufacture and in which increased process speeds and throughput are obtained without requiring undue vigilance over the CMP pad's reaching a worn-out stage undetected, thus increasing throughput and yield. It is a further object of the present invention to provide for automated end-point pad detection that monitors the degree of CMP that has occurred on the wafer under polishing such that the wafer can be properly finished with the new pad without requiring the operator to estimate the proper remaining time for CMP of the wafer with a new polishing pad. A further object of this invention is to provide for self-limiting pad structures that automatically indicate when they are at the end of their useful life mad before the polishing platen has damaged the wafer. A further object of this invention is to provide for an apparatus that is suited for automated end-point detection and an algorithm for end-point detection and for properly finishing a current polishing job with a new pad.

The forgoing objectives are accomplished by a novel abrasive polishing pad having one or more voids incorporated therein. The contents of each void within the fixed abrasive polishing pads facilitates the detection of the end point at which the polishing pad has become worn out during a polishing operation, such as a chemical mechanical polishing operation.

A chemical can be stored within one or more of the voids which, when breached by the wearing of the fixed abrasive pad, releases the chemical therein to the polishing environment. The chemical released from the breached void can be selected to effect a change in the chemical environment of the polishing operation, such as a change that would halt the chemical polishing upon the polished substrate. Alternatively, the chemical released from the breached void can be selected to effect a change in color of the fixed abrasive pad itself. As a further alternative, a friction reducing lubricant can be stored in the one or more voids such that there will be a detectable change in the torque load on the rotating fixed abrasive pad when the lubricate in released from one or more breached voids in the fixed abrasive pad.

Where the one or more voids within the fixed abrasive pad is empty, an audible "chirping" sound from the fixed abrasive pad is produced by fluids such as air that is forced into the one or more voids by the polishing operation, similar to operational principles of a whistle.

The positioning and placement of the one or more voids can be optimized to facilitate a calculation as to the remaining useable life that the fixed abrasive pad. As such, the visual or audible diagnostic resulting from the breach of the one or more voids serve to notify an operator to of a polishing machine when to remove the novel fixed abrasive pad from the polishing surface based upon a calculable remaining time that the novel fixed abrasive pad is capable of polishing the surface so as to yield a uniform polishing of a polished surface.

These and other objects of the invention will become apparent to those skilled in the art after referring to the following description and examples.

BRIEF DESCRIPTION OF THE DRAWINGS

In order that the manner in which the above-recited and other advantages and objects of the invention are obtained may be more fully explained, a more particular description of the invention briefly described above will be rendered by reference to specific embodiments and applications thereof which are illustrated in the appended drawings. Understanding that these drawings depict only typical embodiments and applications of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Additional objects and advantages of the present invention will become readily apparent to those skilled in this art from the following detailed description, wherein preferred embodiments of the invention are shown and described in the disclosure, simply by way of illustration of the best mode contemplated for carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive.

Figure 1:
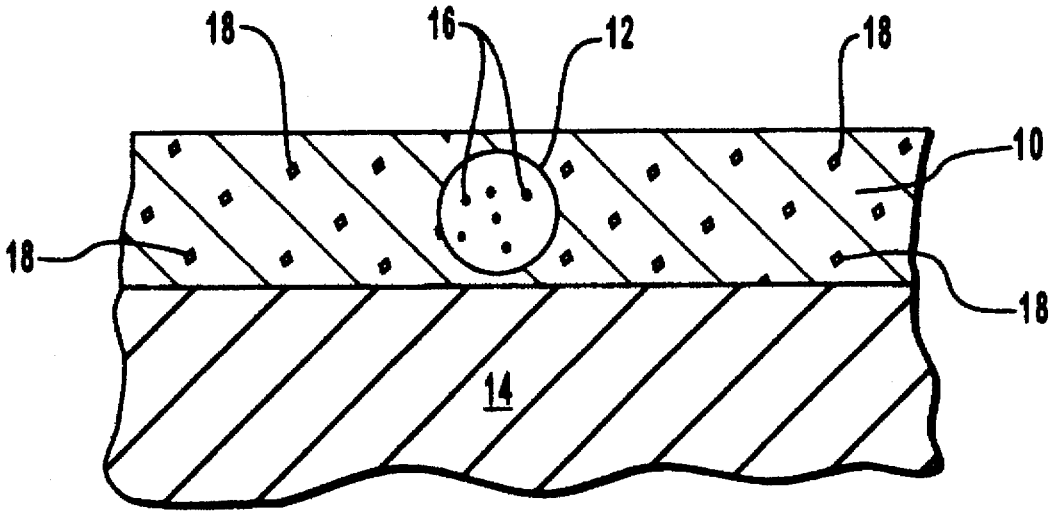
FIG. 1 shows a partial cross-sectional view of an embodiment of a new and unused fixed abrasive pad having an unbreached void incorporated therein.

FIG. 1 shows a partial cross-sectional view of an embodiment of a new and unused fixed abrasive pad 10 having therein an unbreached void 12 containing an indicator substance 16. Fixed abrasive pad 10, which is situated upon a web 14, has many particles of an abrasive 18 incorporated therein. While void 12 is depicted in cross-section as circular, other shapes are contemplated.

Figure 2:
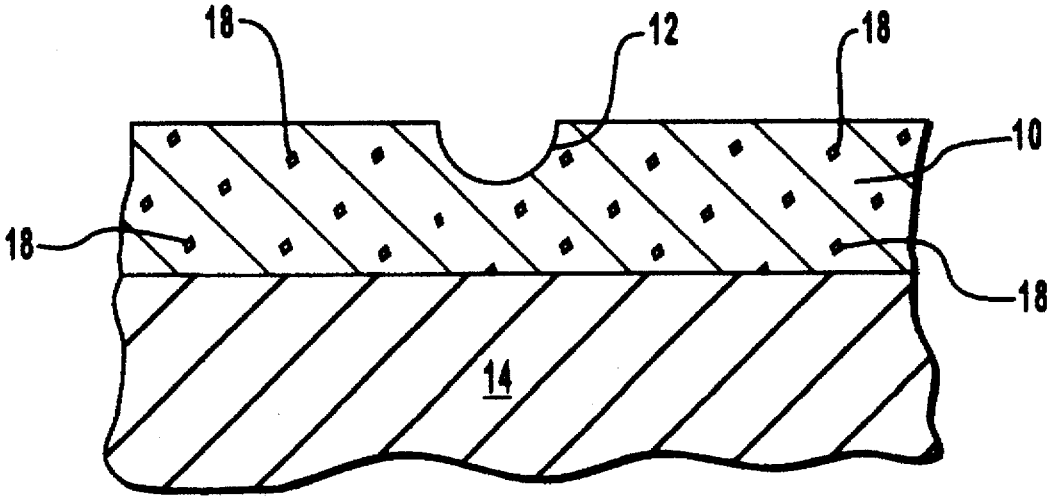
FIG. 2 shows a partial cross-sectional view of the fixed abrasive pad of FIG. 1, where the void has been breached due to wearing down of the fixed abrasive pad so as to release the contents thereof.

FIG. 2 shows a partial cross-sectional view of fixed abrasive pad 10 after being worn down in a polishing operation so as to breach void 12 and release therefrom indicator substance 16.

Figure 3:
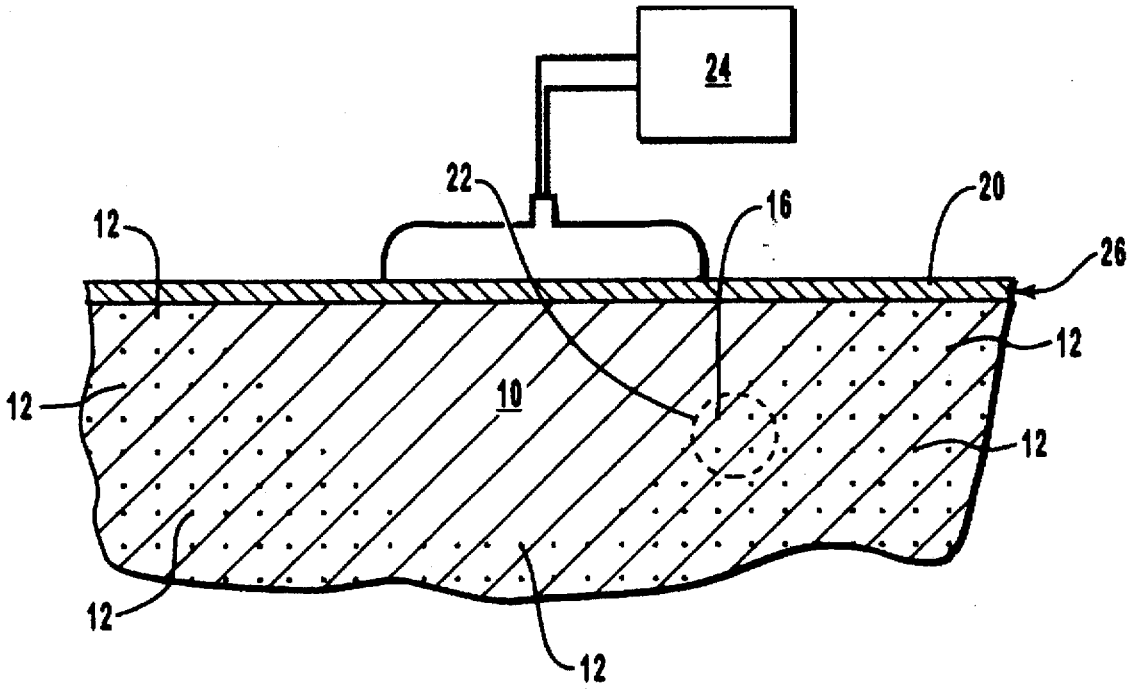
FIG. 3 is a partial cross-sectional view of a preferred embodiment of the novel fixed abrasive pad incorporating therein a plurality of voids, the fixed abrasive pad being used to polish a substrate, such as a semiconductor wafer, in a CMP processing step.
Figure 4:
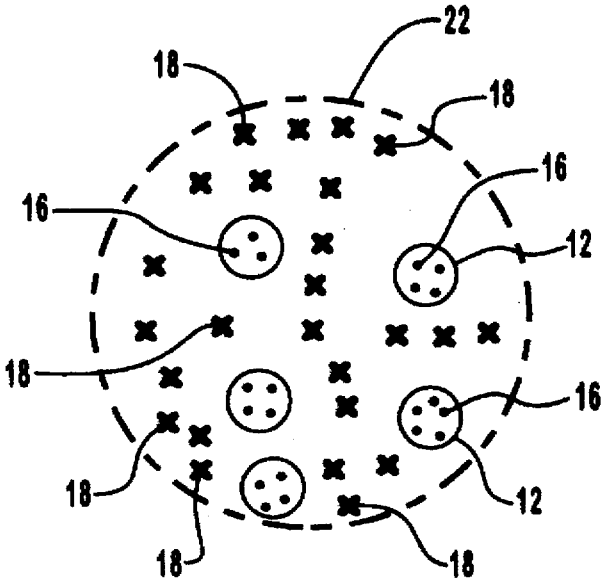
FIG. 4 is an enlarged partial cross-sectional view of the fixed abrasive pad seen in FIG. 3.

A substrate 20 is seen in FIG. 3 as being polished in a CMP polishing operation by fixed abrasive pad 10 having therein a plurality of voids 12 each containing end point indicator substance 16. Substrate 20 can be a glass surface, a semiconductor surface, a dielectric surface, or a semiconductor wafer having integrated circuits thereon. An enlarged view of a cut away cross-section 22 in FIG. 3 is seen in FIG. 4, where several particles of abrasive 18 as shown as placed around and about voids 12.

In a CMP operation, a means for moving at least one of the polishing pad and the semiconductor wafer relative to and in contact with the other is used. By way of example and illustrate of such means, substrate 20 is held by a chuck and rotation arm 24 so as to rotate relative to and in contact with fixed abrasive pad 12. Of course, other and conventional means are also contemplated for this function.

Fluid in the ambient can occupy space between substrate 20 and fixed abrasive pad 10. Air is positively introduced by pressure differentials therebetween, and polishing liquid such as a slurry used in a typically CMP operation can also be positively introduces similarly. The space there between is indicated in FIG. 3 at reference numeral 26.

1. Abrasives

Typically, fixed abrasives, can be silica or ceria, or zirconia particles. An example of such abrasives is seen in FIGS. 1, 2, and 4 as particles of abrasive 18. Recent improvements in the abrasives art include polishing compound accelerants that are either coprecipitated with the abrasive or which are contained in the washing solution, both of which expedite polishing either by enhanced or chemical means or both.

2. Fixed-Abrasive Pads

Fixed-abrasive pads of the present invention are preferably in a range of about 10 to about 100 mils thick. The pads are molded from composite or elastomeric substances and the abrasives can be fixed either before or after the molding process. The fixed abrasives can be laid out within the fixed abrasive pad in a variety of preferred configurations, including squares, 'X' patterns, star patterns, or scattered randomly so as to appear homogeneously from a macroscopic view. Grooves or voids, an example of which is seen in the Figures as voids 12, contain end point indicator substances. Each void may contain an end point indicator substance such as a chemical indicator, a physical indicator such as air only, or an optical indicator such as a die. Voids containing differing end point indicator substances can be combined into a fixed abrasive pad so as to provide a variety of chemical, physical, or optical diagnostics indicative of the wearing of the fixed abrasive pad and the end point of the useful life of the fixed abrasive pad.

Physical end-point indicators include grooves or voids either or both of which can be laid out in patterns similar to the fixed abrasive patterns underlying the fixed abrasives. The voids are also provided in the underlying layer in concentric circles or in a completely random manner that is macroscopically homogeneous. FIG. 3 illustrates a preferred arrangement of voids 12 which facilitates a progressively increasing number of breached voids as the thickness of fixed abrasive pad 10 is reduced during the polishing of substrate 22.

The voids containing the end point indicator substance range in size depending upon the type and nature of the polishing operation When the fixed abrasive pad has substantially worn away, the underlying grooves or voids are exposed and a variety of means for detection are used. First, if the grooves or voids are empty, an audible squeaking or "chirping" of the worn pad will occur. The groove or void size will dictate the chirping pitch. Detection is purely auditory by a polishing machine operator. Alternatively, a sound detector with a feed back loop controller can be incorporated with the polishing machine.

The grooves or voids can become exposed or ruptured all at the same time by fabricating the fixed abrasive pad with the grooves or voids in a coplanar arrangement. This arrangement would create a virtually global, simultaneous, or catastrophic rupturing if desired. Alternatively, the grooves or voids can be vertically staggered so that their rupture is gradual. The stagger is designed to be uniform or nonuniform depending upon the preferred method of end-point detection. A preferred nonuniform stagger is an elution curve profile frequency of occurrence as the pad progressively abrades. Ultra-sensitive detection will notify the operator upon the rupturing of the first few voids, if desired. Less sensitive detection means will notify the operator upon rupture of the bulk of the voids.

Other physical indicators can be used to monitor end point, such as the torque load on the rotating platen. The physical indicator can be a detectable signal in the form of a change in a coefficient of friction between the polishing pad that is in contact the surface being polished. When the lubricant is released from ruptured or breached voids, a change in the coefficient of friction between the polishing pad that is in contact the surface being polished occurs.

When a new fixed abrasive pad is put into service, a polishing machine operator or a digital computer operating the polishing machine can take note of the torque load and a control feedback loop then uses the steady-state torque load of the new fixed abrasive pad as the set point. Tuning a control loop with a preferred reset rate will depend upon that application and is job specific. When the torque load changes materially because the fixed abrasive pad is worn and the apparatus is trying to maintain the set point with a physically changed pad, the operator or the computer then determined whether the fixed abrasive pad is at the end of its wear life. When CMP uses pulsed polishing pressure, the torque-load detection method would require monitoring of a sinusoidal torque wave that is difficult and impractical interpret. Thus, with pulsed polishing, chemical, optical, or audio detection methods are preferred.

In torque-load indicator applications, the grooves or voids can contain substances or can be empty. If the grooves or voids have a lubricating substance, release of the substance will cause a sudden or gradual lessening of the torque load. A lubricating substance that is inert to the polishing surface is preferred because the surface will not be abraded before the operator or computer has been notified that the pad is worn out.

An alternative physical indicator is a simple current meter that monitors the current draw on the rotating platen. When the lubricant in breached voids is released, a change in the torque required to maintain the predetermined RPMs will occur. The operator or a digital computer monitors the current draw and a signal alerts the operator to determine if the change in current draw is due to a worn pad.

Chemical end-point indicators are released, if the grooves or voids contain chemical indicator substances, to announce the end point or even to stop the chemical activity of the CMP process. Chemical indicators include buffering agents that halt the chemical activity of the CMP process. Buffering agents are preferably of pH below neutrality because chemical agents in CMP are used in the range of pH 8–11, preferably 9–10. The preferred pH of the buffer solution is in the range of pH 1–6, more preferably pH 2–5 and most preferably pH 3–4.

Other chemical indicators are dissolved salts or other solutions, which are inert to the chemical makeup of the polishing surface, that have a predetermined electrical conductivity.

As the indicator solutions are washed from the pad and wafer surface, the draining solution passes through a tube and a pH or electrical potential is measured across the solution in the tube. As the pH or conductivity of the solution changes upon release of the indicator in the grooves or voids, an operator or an automated monitoring means stops the CMP apparatus and a new fixed abrasive pad is used to replace the worn pad.

Another indicator solution contemplated in a compound that has an exothermic reaction when exposed to ambient fluids such as the slurry in a CMP process or air around the fixed abrasive pad.

Alternative chemical indicators contemplated are cleaning solutions that assist in removing dislodged abrasives from the wafer surface. Because a surface on a semiconductor wafer must be cleaned after CMP and before a next processing step, the chemical end point indicator in the one or more of the voids is selected to begin the cleaning process. Each CMP step in semiconductor processing introduces metal contaminants onto the surface of the substrate. A cleaning solution is applied to the semiconductor substrate to remove the metal contaminants. The cleaning solution comprises an organic solvent and a compound containing fluorine. The chemical constituents of the cleaning solution are effective in the removal of metal contaminants from the surface of the semiconductor substrate, yet are substantially unreactive with any metal interconnect material underlying a dielectric layer. As such, the early introduction of the cleaning step shortens of the processing time and an increases throughput.

Optical indicators include inert dyes that are released from the ruptured voids that stain the worn polishing pad. An operator of the polishing machine then sees a color change, e.g. through a sight tube that conveys the washing solution away from the polishing surface. Alternatively, a spectrophotometer can be used to monitor a sight tube that conveys the washing solution away from the polishing surface. A signal from the spectrophotometer is processed to derive therefrom an announcement as to the end point of the useful life of the fixed abrasive pad, such as when a dye that has been disbursed from ruptured voids flows through a sight tube being monitored by the spectrophotometer.

Depending upon the content of the voids, the diagnostic or the detectable signal from the contents of the voids will be proportional to the amount of such contents release from the fixed abrasive pad as the number of voids that are abraded by the polishing operation increases. Thus, as seen in FIG. 3, deeper wear into fixed abrasive pad 10 breached increasingly more voids 12 to release an increasingly amount of end point indicator substance 16.

3. Polishing Apparatuses

In employing a conventional CMP apparatus, wafers to be polished are mounted on polishing blocks which are placed on the CMP machine. A polishing pad is adapted to engage the wafers carried by the polishing blocks. A cleaning agent can be dripped onto the pad continuously during the polishing operation while pressure is applied to the wafer. A typical CMP apparatus comprises a rotatable polishing platen, and a polishing pad mounted on the platen. A motor for the platen can be controlled by a microprocessor to spin at about 10 RPM to about 80 RPM. The wafer can alternatively be mounted on the bottom of a rotatable polishing head so that a major surface of the wafer to be polished is positionable to contact the underlying polish pad.

The wafer and polishing head can be attached to a vertical spindle which is rotatably mounted in a lateral robotic arm which rotates the polishing head at about 10 to about 80 RPM in the same direction as the platen and radially positions the polishing head.

The robotic arm can also vertically position the polishing head to bring the wafer into contact with polishing head and maintain an appropriate polishing contact pressure.

A tube opposite the polishing head and above the polishing pad can dispense and evenly saturate the pad with an appropriate cleaning agent, typically a slurry. If the pad contains fixed abrasive, the cleaning agent can be a simple rinse or a chemical that enhances the polishing.

The inventive polish pads, and systems and methods incorporating same are contemplated to place abrasive particles within the pad itself and/or a slurry used in the inventive polishing methods. Thus, an inventive elastomeric pad without or without abrasives is proposed.

In the present inventive fixed abrasive pad can be used with inert or non-inert indicator substances are employed on a parallel test wafer. The parallel test wafer has a surface thereon that is to planarized identically to production wafer. The parallel test wafer, however, is only employed to indirectly monitor the polishing of production wafers by the fixed abrasive pad. For multiple-wafer planarizing and the resulting higher production rate of planarized wafers, there will be employed a plurality of fixed abrasive pads for a plurality of production wafers mounted on rotatable platens, and a test wafer likewise being equivalently planarized on a pad that contains the indicator layer or layers. The test wafer and the production wafers are all subject to the same fixed abrasives, RPMs, pressures, temperatures, and chemical or physical washings or rinsings. The end point indicator substance, however, is contained in voids found only within the fixed abrasive pad used to planarize the test wafer. As such the end point indicator substance can be destructive to the test wafer, in destructive testing process, without significantly effecting yield.

4. End-Point Detection Methods

The present invention allows for maximum use of fixed abrasive pads without damaging one or several wafers after the polishing pad is worn out but before it was detected. By maximizing the useful life of the polishing pad, fewer shutdowns are required because previously the operator would replace the pad after an arbitrary number of cycles, some number fewer than the maximum the pad could deliver. Over time, throughput and yield are increased, and downtime is minimized.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A polishing pad comprising:

an elastomeric substance having a polishing surface; and an end point indicator substance comprising a fluid incorporated within the elastomeric substance beneath the polishing surface for producing a detectable signal as abrading of the elastomeric substance releases the end point indicator substance therefrom.

2. The polishing pad as defined in claim 1, wherein the detectable signal is a color and the end point indicator substance is a dye.

3. The polishing pad as defined in claim 1, wherein the detectable signal is a sound and the end point indicator substance is a gaseous fluid.

4. The polishing pad as defined in claim 1, wherein the detectable signal is a change in the pH of a first fluid on the polishing pad, and the end point indicator substance is a second fluid having a pH opposite that of the first fluid on the polishing pad.

5. The polishing pad as defined in claim 1, wherein the detectable signal is a change in electrical conductivity of a first fluid on the polishing pad, and the end point indicator substance is a second fluid causing a change having electrical conductivity when introduced to the first fluid on the polishing pad.

6. The polishing pad as defined in claim 1, wherein the detectable signal is a change in a metal contaminants concentration a first fluid on the polishing pad, and the end point indicator substance is a second fluid causing a change the metal contaminants concentration of the first fluid when introduced to the first fluid on the polishing pad.

7. The polishing pad as defined in claim 1, wherein the detectable signal is a change in a coefficient of friction between the elastomeric substance in contact with a polished surface, and the end point indicator substance is a lubricant causing a change the coefficient of friction between the elastomeric substance and the polished surface when introduced therebetween.

8. The polishing pad as defined in claim 1, wherein the detectable signal is a change in the temperature of the elastomeric substance, and the end point indicator substance is a material causing an exothermic reaction when exposed to the ambient outside the elastomeric substance.

9. The polishing pad as defined in claim 1, wherein a void is incorporated within the elastomeric substance beneath the polishing surface and is partially filled by said end point indicator substance therein.

10. The polishing pad as defined in claim 9, further comprising a plurality of said void.

11. The polishing pad as defined in claim 10, wherein said plurality of said void are configured in substantially a single geometric plane.

12. The polishing pad as defined in claim 10, wherein said plurality of said void are vertically staggered.

13. The polishing pad as defined in claim 1, wherein an abrasive material is incorporated within said elastomeric substance.

14. A polishing system comprising:

a polishing pad including:

a composite substance having a polishing surface; and an end point indicator substance comprising a fluid incorporated within the composite substance beneath the polishing surface for producing a detectable signal as abrading of the composite substance releases the end point indicator substance therefrom;

a semiconductor substrate having a surface to be polished by said polishing pad; and a tool for moving at least one of the polishing pad and the surface to be polished by said polishing pad relative to and in contact with the other.

15. The polishing system as defined in claim 14, wherein the detectable signal is a color and the end point indicator substance is a dye.

16. The polishing system as defined in claim 14, wherein the detectable signal is a sound and the end point indicator substance is a gaseous fluid.

17. The polishing system as defined in claim 14, wherein a first fluid is positively introduced between said polishing pad and said semiconductor substrate, and wherein the detectable signal is a change in the pH of the first fluid on the polishing pad, and the end point indicator substance is a second fluid having a pH opposite that of the first fluid on the polishing pad.

18. The polishing system as defined in claim 14, wherein a first fluid is positively introduced between said polishing pad and said semiconductor substrate, and wherein the detectable signal is a change in electrical conductivity of said first fluid positively introduced between said polishing pad and said semiconductor substrate, and the end point indicator substance is a second fluid causing a change having electrical conductivity when introduced to the first fluid.

19. The polishing system as defined in claim 14, wherein a first fluid is positively introduced between said polishing pad and said semiconductor substrate, and wherein the detectable signal is a change in a metal contaminants concentration of the first fluid positively introduced between said polishing pad and said semiconductor substrate, and the end point indicator substance is a second fluid causing a change the metal contaminants concentration of the first fluid when introduced to the first fluid.

20. The polishing system as defined in claim 14, wherein the detectable signal is a change in a coefficient of friction between the composite substance in contact with a polished surface, and the end point indicator substance is a lubricant causing a change the coefficient of friction between the composite substance and the polished surface when introduced therebetween.

21. The polishing system as defined in claim 14, wherein a first fluid is positively introduced between said polishing pad and said semiconductor wafer, and wherein the detectable signal is a change in the temperature of the first fluid, and the end point indicator substance is a material causing an exothermic reaction when exposed to said first fluid.

22. The polishing system as defined in claim 14, wherein a void has said end point indicator substance therein.

23. The polishing system as defined in claim 22, further comprising a plurality of said void.

24. The polishing system as defined in claim 23, wherein said plurality of said void are configured in substantially a single geometric plane.

25. The polishing system as defined in claim 23, wherein said plurality of said void are vertically staggered.

26. The polishing system as defined in claim 14, wherein an abrasive material is incorporated within composite substance.

27. A method of detecting the wear end-point of a polishing pad comprising the steps of:

providing a polishing pad including:

a composite substance having a polishing surface; and an end point indicator substance comprising a fluid incorporated within the composite substance beneath the polishing surface for producing a detectable signal as abrading of the composite substance releases the end point indicator substance therefrom;

providing a semiconductor substrate having a unpolished surface to be polished by said polishing pad;

moving the polishing pad relative to and in contact with the unpolished surface to be polished by said polishing pad so as to abrade the composite substance and release therefrom the end point indicator substance; and detecting said detectable signal when the composite substance releases the end point indicator substance therefrom; whereby a status of said polishing pad is indicated.

28. The method as defined in claim 27, further comprising the steps of:

(a) stopping the movement of at least one of said another polishing pad and the unpolished surface relative to and in contact with the other;

(b) removing the polishing pad;

(c) providing another polishing pad of like kind;

(d) moving at least one of said another polishing pad and the unpolished surface relative to and in contact with the other so as to abrade the composite substance and release therefrom the end point indicator substance; and (e) detecting said detectable signal when the composite substance releases the end point indicator substance therefrom; whereby a status of said another polishing pad is indicated.

(f) repeating steps (a)–(e).

29. The method as defined in claim 27, wherein the detectable signal is a color and the end point indicator substance is a dye.

30. The method as defined in claim 27, wherein the detectable signal is a sound and the end point indicator substance is a gaseous fluid.

31. The method as defined in claim 27, further comprising the step of positively introducing a first fluid between said polishing pad and said semiconductor substrate, and wherein the detectable signal is a change in the pH of the first fluid on the polishing pad, and the end point indicator substance is a second fluid having a pH opposite that of the first fluid on the polishing pad.

32. The method as defined in claim 27, further comprising the step of positively introducing a first fluid between said polishing pad and said semiconductor substrate, and wherein the detectable signal is a change in electrical conductivity of said first fluid positively introduced between said polishing pad and said semiconductor substrate, and the end point indicator substance is a second fluid causing a change having electrical conductivity when introduced to the first fluid.

33. The method as defined in claim 27, further comprising the step of positively introducing a first fluid between said polishing pad and said semiconductor substrate, and wherein the detectable signal is a change in a metal contaminants concentration of the first fluid positively introduced between said polishing pad and said semiconductor substrate, and the end point indicator substance is a second fluid causing a change the metal contaminants concentration of the first fluid when introduced to the first fluid.

34. The method as defined in claim 27, wherein the detectable signal is a change in a coefficient of friction between the composite substance in contact with a polished surface, and the end point indicator substance is a lubricant causing a change the coefficient of friction between the composite substance and the polished surface when introduced therebetween.

35. The method as defined in claim 27, wherein a first fluid is positively introduced between said polishing pad and said semiconductor substrate, and wherein the detectable signal is a change in the temperature of the first fluid, and the end point indicator substance is a material causing an exothermic reaction when exposed to said first fluid.

36. The method as defined in claim 27, wherein a void has said end point indicator substance therein.

37. The method as defined in claim 36, further comprising a plurality of said void.

38. The method as defined in claim 37, wherein said plurality of said void are configured in substantially a single geometric plane.

39. The method as defined in claim 37, wherein said plurality of said void are vertically staggered.

40. The method as defined in claim 27, wherein an abrasive material is incorporated within the composite substance.

41. The method as defined in claim 27, wherein the detectable signal is proportional to the amount of the end point indicator substance released from the composite substance.

42. A polishing pad comprising:

an elastomeric substance having a polishing surface; and a void, incorporated within the elastomeric substance beneath the polishing surface and containing therein an end point indicator substance comprising a fluid, wherein a detectable signal is produced as abrading of the elastomeric substance releases the end point indicator substance from said void.

43. The polishing system as defined in claim 42, further comprising a plurality of said void.

44. The polishing system as defined in claim 43, wherein said plurality of said void are configured in substantially a single geometric plane.

45. The polishing system as defined in claim 43, wherein said plurality of said void are vertically staggered.

46. The polishing pad as defined in claim 42, wherein the detectable signal is a color and the end point indicator substance is a dye.

47. The polishing pad as defined in claim 42, wherein the detectable signal is a sound and the end point indicator substance is a gaseous fluid.

48. The polishing pad as defined in claim 42, wherein the detectable signal is a change in the pH of a first fluid on the polishing pad, and the end point indicator substance is a second fluid having a pH opposite that of the first fluid on the polishing pad.

49. The polishing pad as defined in claim 42, wherein the detectable signal is a change in electrical conductivity of a first fluid on the polishing pad, and the end point indicator substance is a second fluid causing a change having electrical conductivity when introduced to the first fluid on the polishing pad.

50. The polishing pad as defined in claim 42, wherein the detectable signal is a change in a metal contaminants concentration a first fluid on the polishing pad, and the end point indicator substance is a second fluid causing a change the metal contaminants concentration of the first fluid when introduced to the first fluid on the polishing pad.

51. The polishing pad as defined in claim 42, wherein the detectable signal is a change in a coefficient of friction between the elastomeric substance in contact with a polished surface, and the end point indicator substance is a lubricant causing a change the coefficient of friction between the elastomeric substance and the polished surface when introduced therebetween.

52. The polishing pad as defined in claim 42, wherein the detectable signal is a change in the temperature of the elastomeric substance, and the end point indicator substance is a material causing an exothermic reaction when exposed to the ambient outside the elastomeric substance.

53. The polishing pad as defined in claim 42, wherein an abrasive material is incorporated within said elastomeric substance.

54. A polishing pad comprising:

an elastomeric substance having a polishing surface; and a lubricant incorporated within the elastomeric substance beneath the polishing surface for producing a change in a coefficient of friction between the elastomeric substance in contact with a polished surface as abrading of the elastomeric substance releases the end point indicator substance therefrom.

55. A polishing pad comprising:

an elastomeric substance having a polishing surface; and a material causing an exothermic reaction when exposed to the ambient outside the elastomeric substance, said material being incorporated within the elastomeric substance beneath the polishing surface and producing a change in the temperature of the elastomeric substance as abrading of the elastomeric substance releases the material therefrom.

56. A polishing pad comprising:

an elastomeric substance having a polishing surface; and a void incorporated within the elastomeric substance beneath the polishing surface, said void being partially filled with an end point indicator substance for producing a detectable signal as abrading of the elastomeric substance releases the end point indicator substance from said void.

57. A polishing system comprising:

a polishing pad including:

a composite substance having a polishing surface; and a lubricant, incorporated within the composite substance beneath the polishing surface, for producing a change in a coefficient of friction between the composite substance in contact with a polished surface as abrading of the composite substance releases the end point indicator substance therefrom;

a semiconductor substrate having a surface to be polished by said polishing pad; and a tool for moving at least one of the polishing pad and the surface to be polished by said polishing pad relative to and in contact with the other.

58. A polishing system comprising:

a polishing pad including:

a composite substance having a polishing surface; and end point indicator substance incorporated within the composite substance beneath the polishing surface for producing a detectable signal as abrading of the composite substance releases the end point indicator substance therefrom;

a semiconductor substrate having a surface to be polished by said polishing pad, wherein a first fluid is positively introduced between said polishing pad and said semiconductor substrate, and wherein the detectable signal is a change in the temperature of the first fluid, and the end point indicator substance is a material causing an exothermic reaction when exposed to said first fluid; and a tool for moving at least one of the polishing pad and the surface to be polished by said polishing pad relative to and in contact with the other.

59. A polishing system comprising:

a polishing pad including:

a composite substance having a polishing surface; and a void incorporated within the elastomeric substance beneath the polishing surface and partially filled with an end point indicator substance for producing a detectable signal as abrading of the elastomeric substance releases the end point indicator substance from said void;

a semiconductor substrate having a surface to be polished by said polishing pad; and a tool or moving at least one of the polishing pad and the surface to be polished by said polishing pad relative to and in contact with the other.

60. A method of detecting the wear end-point of a polishing pad comprising:

providing a polishing pad including:

a composite substance having a polishing surface; and a lubricant incorporated within the elastomeric substance beneath the polishing surface for producing a detectable signal comprising a change in a coefficient of friction between the elastomeric substance in contact with a polished surface as abrading of the elastomeric substance releases the end point indicator substance therefrom;

providing a semiconductor substrate having a unpolished surface to be polished by said polishing pad;

moving the polishing pad relative to and in contact with the unpolished surface to be polished by said polishing pad so as to abrade the composite substance and release therefrom the end point indicator substance; and detecting said detectable signal when the composite substance releases the end point indicator substance therefrom; whereby a status of said polishing pad is indicated.

61. A method of detecting the wear end-point of a polishing pad comprising:

providing a polishing pad including:

a composite substance having a polishing surface; and end point indicator substance incorporated within the composite substance beneath the polishing surface for producing a detectable signal as abrading of the composite substance releases the end point indicator substance therefrom;

providing a semiconductor substrate having a surface to be polished by said polishing pad, wherein a first fluid is positively introduced between said polishing pad and said semiconductor substrate, and wherein the detectable signal is a change in the temperature of the first fluid, and the end point indicator substance is a material causing an exothermic reaction when exposed to said first fluid;

moving the polishing pad relative to and in contact with the unpolished surface to be polished by said polishing pad so as to abrade the composite substance and release therefrom the end point indicator substance; and detecting said detectable signal when the composite substance releases the end point indicator substance therefrom; whereby a status of said polishing pad is indicated.

62. A method of detecting the wear end-point of a polishing pad comprising:

providing a polishing pad including:

a composite substance having a polishing surface; and a void incorporated within the elastomeric substance beneath the polishing surface and partially filled with an end point indicator substance for producing a detectable signal as abrading of the elastomeric substance releases the end point indicator substance from said void;

providing a semiconductor substrate having a surface to be polished by said polishing pad, wherein a first fluid is positively introduced between said polishing pad and said semiconductor substrate, and wherein the detectable signal is a change in the temperature of the first fluid, and the end point indicator substance is a material causing an exothermic reaction when exposed to said first fluid;

moving the polishing pad relative to and in contact with the unpolished surface to be polished by said polishing pad so as to abrade the composite substance and release therefrom the end point indicator substance; and detecting said detectable signal when the composite substance releases the end point indicator substance therefrom; whereby a status of said polishing pad is indicated.

* * * * *

UNITED STATES PATENT AND TRADEMARK OFFICE

CERTIFICATE OF CORRECTION

PATENT NO. : 5,733,176

DATED : Mar. 31, 1998

INVENTOR(S) : Karl M. Robinson; Michael A. Walker

It is certified that error appears in the above-identified patent and that said Letters Patent are hereby corrected as shown below:

Col. 2, line 27, after "complexity" insert --of--

Col. 2, line 66, after "The" change "forgoing" to --foregoing--

Col. 3, line 18, after "lubricate" change "in" to --is--

Col. 3, line 20, before "the" change "Where" to --When--

Col. 3, line 27, after "life" change "that" to --of--

Col. 4, line 34, after "shown" change "as" to --are--

Col. 4, line 37, after "polishing" change "pad" to --pads--

Col. 4, line 39, before "of" change "illustrate" to --illustration--

Col. 4, line 41, after "pad" change "12" to --10--

Col. 4, line 48, after "positively" change "introduces" to --introduced--

Col. 4, line 48, after "introduces" change "similarly" to --in a similar fashion--

Col. 5, line 22, after "substrate" change "22" to --20--

Col. 5, line 54, after "contact" insert --with--

Col. 5, line 57, after "contact" insert --with--

UNITED STATES PATENT AND TRADEMARK OFFICE

CERTIFICATE OF CORRECTION

PATENT NO. : 5,733,176

DATED : Mar. 31, 1998

INVENTOR(S) : Karl M. Robinson; Michael A. Walker

It is certified that error appears in the above-identified patent and that said Letters Patent are hereby corrected as shown below:

Col. 6, line 1, before "whether" change "determined" to --determines--

Col. 6, line 4, after "impracatical" insert --to--

Col. 6, line 64, after "shortens" delete --of--

Col. 7, line 13, after "contents" change "release" to --released--

Col. 7, line 17, after "an" change "increasingly" to --increasing--

Col. 7, line 49, after "incorporating" insert --the--

Col. 7, line 52, after "pad" change "without" to --with--

UNITED STATES PATENT AND TRADEMARK OFFICE

CERTIFICATE OF CORRECTION

PATENT NO. : 5,733,176

DATED : Mar. 31, 1998

INVENTOR(S) : Karl M. Robinson; Michael A. Walker

It is certified that error appears in the above-identified patent and that said Letters Patent is hereby corrected as shown below:

Col. 7, line 53, delete "In" and change "the" to --the--"

Col. 7, line 54, after "substances" insert --which--

Col. 7, line 56, after "is" delete --to--

Signed and Sealed this

Ninth Day of February, 1999

*Attest:*

*Attesting Officer*

*Acting Commissioner of Patents and Trademarks*